United States Patent [19]

Bestel

[11] Patent Number: 4,982,059

[45] Date of Patent: Jan. 1, 1991

[54] AXIAL MAGNETIC FIELD INTERRUPTER

[75] Inventor: Ernest F. Bestel, Brookfield, Wis.

[73] Assignee: Cooper Industries, Inc., Houston, Tex.

[21] Appl. No.: 459,449

[22] Filed: Jan. 2, 1990

[51] Int. Cl.[5] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 4,390,762 | 6/1983 | Watzke | 200/144 B |
| 4,438,307 | 3/1984 | Lippmann et al. | 200/144 B |
| 4,839,481 | 6/1989 | Nash et al. | 200/144 B |

*Primary Examiner*—Robert S. Macon

*Attorney, Agent, or Firm*—Michael F. Heim

[57] ABSTRACT

A cylindrical coil conductor incorporated in a vacuum interrupter comprises a cylindrical body with a plurality of inclined slits therein defining a plurality of current paths. The coil conductor is uniformly cylindrical to reduce radial magnetic fields, which tend to cancel the axial magnetic field generated by the coil conductor. The cylindrical coil conductor electrically connects to the rear surface of a main electrode through a copper ring to maintain current on the periphery of the main electrode. The front surface of the main electrode includes a ring-shaped protrusion to define a point of contact with an opposite main electrode. Current flows into the protrusion, through the main electrode to the copper ring, thereby defining a short current path with a minimal resistance.

13 Claims, 5 Drawing Sheets

AXIAL MAGNETIC FIELD INTERRUPTER

BACKGROUND OF THE INVENTION

The present invention relates to a vacuum interrupter and more particularly to an improved electrode structure for a vacuum interrupter. Still more particularly, the invention relates to an improved electrical connector and main electrode structure forming a part of the electrodes for a vacuum interrupter.

A vacuum interrupter for handling a high current generally includes a pair of main electrodes disposed in a vacuum vessel so that at least one of the pair is movable toward and away from the other, coil conductors mounted on the rear surfaces of the main electrodes, and conductor rods extending to the exterior of the vacuum vessel from the rear surfaces of the coil conductors. Current flows from one of the conductor rods to the other through the coil conductors and main electrodes. When one of the conductor rods is urged by an actuator for the purpose of interrupting the current, at least one of the main electrodes is moved away from the other, and an arc current is caused to flow between the spaced electrodes. This arc current is dispersed into a plurality of filament-like arc currents by a magnetic field created by the flow current through the coil conductors.

Electrical connectors provide a bridge for current flow between the main electrode and the coil conductor. When the main electrodes are in the closed position of contact and in contact with each other, current flows through the points of contact between the main electrodes. Thus, current flows through the main electrode between path defined by the electrical connectors and the points of contact. Because the points of contact between the main electrodes varies with the construction of each main electrode, it is impossible to predict the correct path through the main electrode. Preferably, the current will flow through the periphery of the min electrode, when the distance to the electrical connector is shortest and thus where ohmic resistance is lowest. However, in many situations, the point of contact will be in the middle of the main electrodes, where the distance and the electrical connector is greatest and ohmic resistance consequently is much higher. As resistance increases the likelihood of thermal breakdown also increases. Oftentimes the thermal breakdown results in the main electrodes welding together at their middle. Once the main electrodes weld together, it becomes extremely difficult to separate them.

U.S. Pat. No. 3,946,179 discloses a coil conductor that comprises a plurality of conductive arms connected to arcuate sections. The arms connect at one end to a conductor rod and diverge in a generally radial direction therefrom to connect to an arcuate section at the other end. The arcuate sections extend circumferentially from the arms and connect to a main electrode. A plurality of arms and associated arcuate sections with clearances formed between adjacent arcuate sections, form an imaginary coil of one turn. Current flows from the rod to the main electrode through the spaced arms and associated arcuate sections. The one-turn current produces a uniform axial magnetic field that produces the diffuse, filamentary arc currents between the main electrodes.

The use of the clearance in U.S. Pat. No. 3,946,179 to produce the coil effect in the coil conductor results in a weak axial magnetic field in the region of the clearances. Arc currents have a tendency to migrate from a low intensity region toward a high intensity region of an axial magnetic field. Thus, the arc current flowing into the main electrode migrates away from the region of the clearances, causing localized overheating of the main electrode. Because the entire area of the main electrode cannot be utilized effectively for the current interruption, it becomes necessary to increase the size of the main electrode. In addition, there is no provision to maintain current in the periphery of the main electrodes when they are in contact, increasing the possibility that current will flow through the center of the main electrode.

In commonly assigned U.S. Pat. No. 4,837,481, a uniform axial magnetic field is produced by providing parallel slits in the coil conductors. However, the configuration of the electrical connectors still provide certain limitations in the life of the main electrode. Although greatly improving over the prior art, the arc current still is not maintained consistently around the periphery of the main electrode when the main electrodes are in contact. In U.S. Pat. No. 4,839,481, current passes from the coil conductor to the main electrode through electrical connectors. When the main electrodes are in the closed position and in contact with each other the contact resistance depend on the location of the points of contact between the main electrodes. If the points of contact are in the center of the main electrodes the current will be forced through a region of relatively high resistance, causing the temperature of the main electrode to increase, until thermal breakdown results. In a worst case scenario, the main electrodes weld together and cannot be separated.

In commonly assigned U.S. Pat. No. 4,871,808, incorporated herein by reference, a uniform axial magnetic field is maximized, thereby providing an arc current that is more evenly distributed. The axial magnetic field is maximized by reducing the radial magnetic field through the use of a uniform cylindrical coil conductor. In addition, the invention disclosed a structure support rod to reduce mechanical stress. However, as in U.S. Pat. No. 4,839,471, current is forced through the points of contact between the main electrodes. As a result, current tends to flow in the center of the main electrodes, thereby increasing the resistance of the main electrodes and shortening the life of the main electrodes.

SUMMARY OF THE INVENTION

Accordingly, there is provided herein a small, compact vacuum interrupter that provides constant low contact resistance. The improved vacuum interrupter includes an electrode structure with a main electrode for maintaining a low resistance current path. The main electrode has a ring-shaped protrusion on its center side for contacting the opposing main electrode. The improved electrode structure also includes a coil conductor for increasing the axial magnetic field within the vacuum vessel. A number of electrical connectors extend from the opposing end of the coil conductor for providing current to the main electrode. The ring-shaped protrusion on the main electrode provides a contact point in a region that is closest to the electrical connectors. A copper ring is interposed between the electrical connector and main electrodes to maintain current at the periphery of the main electrode. The coil conductor includes a plurality of inclined slits, at least two, formed on a cylindrical body, defining separate current paths of approximately one-half turn each around the circumference of the cylindrical coil conductor. Current flows axially through an external conductor rod, radially through a conductor disk, and then axially through the coil conductor and the several current paths defined thereon.

Two substantially identical electrode structures are provided in the vacuum vessel so that the inclined slits on each of the opposing coil conductors are generally parallel. Thus, current flows from a first external conductor rod, through a first conductor disk, and then through the several current paths defined by the coil conductor to an electrical connector. Current flows through the electrical connector to the copper disc to the periphery of the main electrode to the protrusion on the main electrode. The current passes from the protrusion on a first main electrode to the protrusion on the opposing electrode structure, which is, in effect, a mirror image of the first electrode structure. The slits and current paths on the two opposing conductor coils are aligned such that the current effectively flows through one full turn as it passes through the vacuum vessel. Consequently, a strong, uniform axial magnetic field is applied to the two main electrodes, and current arcing between the spaced main electrodes can be more uniformly distributed over the entire surfaces of the main electrodes. Furthermore, the current flows through a low resistance path as it passes through the closed main electrodes, from the protrusion to the copper ring.

BRIEF DESCRIPTION OF THE DRAWINGS

For a more detailed description of the preferred embodiment of the invention, reference will now be made to the accompanying drawings, wherein.

DETAILED DESCRIPTION OF THE PREFERRED EMBODIMENT

Figure 1:
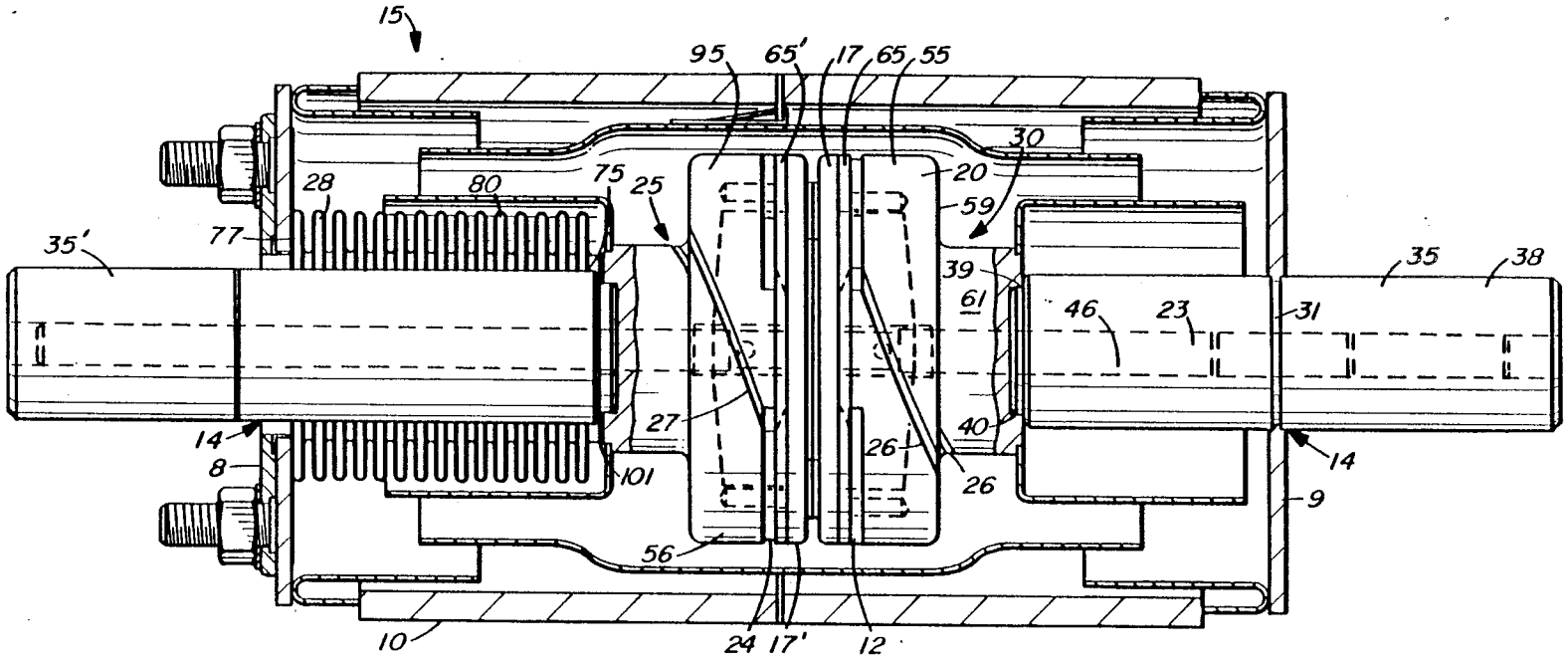
FIG. 1 is a sectional, schematic side elevation view of a vacuum interrupter constructed in accordance with the present invention.

The vacuum interrupter of the present invention comprises an improved design of the interrupter disclosed in commonly assigned U.S. Pat. Nos. 4,839,481 and 4,871,888 which are incorporated by reference herein. Referring now to FIG. 1, a vacuum interrupter constructed in accordance with the preferred embodiment of the present invention, includes a vacuum vessel 15, a movable electrode structure 25 displaced along the central axis of vessel 15, a stationary electrode structure 30 disposed along the central axis of the vacuum vessel 15 opposite the movable electrode structure 25, and a bellows 28 for displacing the movable electrode structure 25 axially within the vessel 15. Displacing the movable electrode structure 25 from the stationary electrode structure 30 causes current flowing between the two electrode structures to arc across the gap between the structures, as discussed more fully herein.

Referring still to FIG. 1, vacuum vessel 15 preferably comprises a pair of end plates 8, 9 mounted on both ends of a cylindrical member 10. End plates 8, 9 have a generally circular configuration with a radius r and a central circular aperture 14 therethrough. Cylindrical member 10 also has a radius r and is constructed of an electrically insulative material. End plates 8, 9 fixedly attach to and enclose both ends of cylindrical member 10 to define a controlled environment within the vessel 15.

Figure 2:
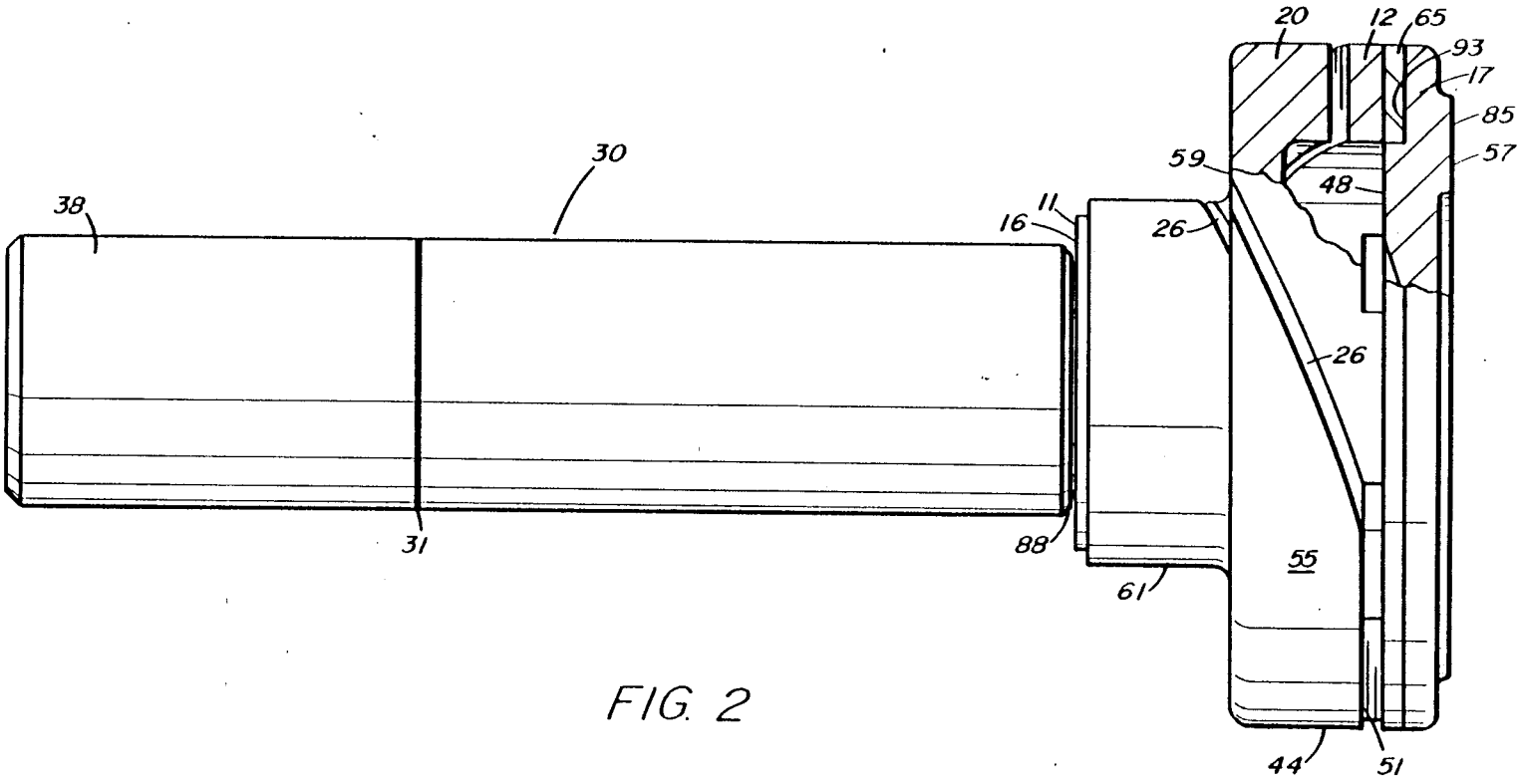
FIG. 2 is a partially sectional, schematic side elevation view of one of the two electrode structures shown in FIG. 1.
Figure 4:
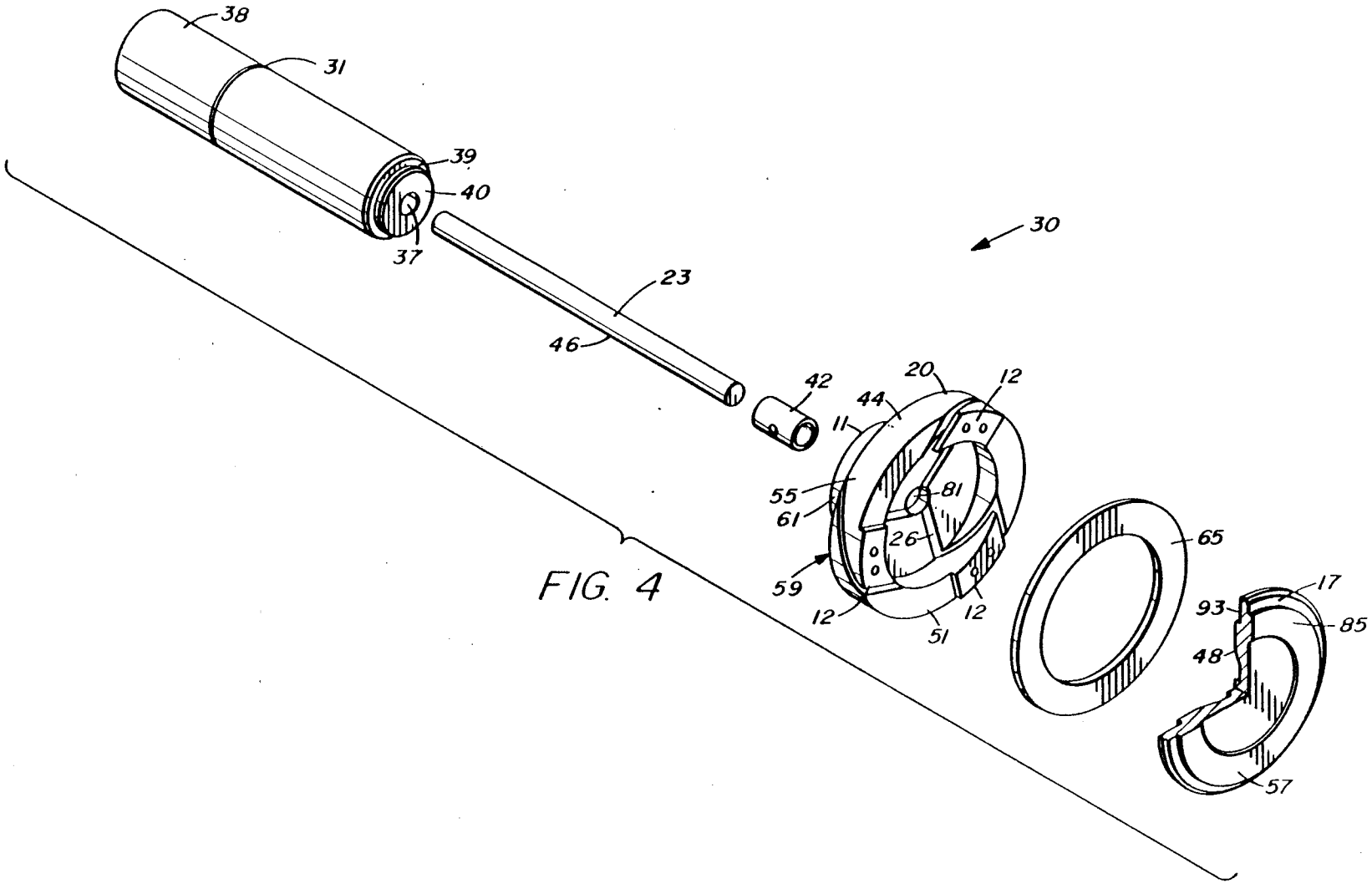
FIG. 4 is a perspective view of one of the two electrode structures incorporated in the vacuum interrupter shown in FIG. 2.

Referring now to FIGS. 1, 2 and 4, the stationary electrode structure 30 constructed in accordance with the preferred embodiment comprises an external conductor rod 35 extending through the central aperture 14 of end plate 9, a generally cylindrical coil conductor 20 electrically connected at one end to conductor rod 35, a copper ring 65 electrically connected to coil conductor 20, a main electrode 17 electrically connected to copper ring 65 and a structural support rod 23 extending along the central axis of the electrode structure 30.

The external conductor rod 35 is constructed of an electrically conductive material, such as copper, and includes an external end 38, an internal end 40 having an outer diameter slightly less than that of the external end, a transversal groove 31 around the circumference of rod 35 and a circumferential lip 39 defined by the juncture of the external and internal ends 38, 40. The conductor rod 35 also includes a central bore 37 extending axially through the rod 35. Upon assembly, the groove 31 engages the end plate 9 adjacent to the central aperture 14 with the external end 38 of rod 35 extending therefrom externally of the vacuum vessel 15 and the internal end 40 of the rod 35 protruding through aperture 14 into the interior of vacuum vessel 15 along the central axis of the vessel. The central bore 37 receives one end of the structural support rod 23 to concentrically align and mechanically support the electrode structure.

Referring still to FIGS. 1, 2 and 4, the coil conductor 20 constructed in accordance with the preferred embodiment comprises a generally cylindrical structure 44, integrally attached to connector section 61. The cylindrical structure 44 includes an internal end 51, a lower end 59 and a plurality of inclined slits 26 machined into the cylindrical structure 44 along its entire axial length. Cylindrical structure 44 and connector section 61 are constructed of an electrically conductive material. Referring to FIG. 2, connection section 61 has an outer diameter equal to the inner diameter of cylindrical structure 44, and has a lip 88 that abuts the lower end 59 of structure 44. Connector section 61 includes a bore 81 extending therethrough for receiving the support rod 23 and a recess 16 in exterior end 11 for receiving rod 35. Slits 26 continue through the cylindrical structure 44, into connector section 61, when the slits intersect bore 81. The connector section engages the lip 39 of rod 35 in recess 16. Slits 26 extend from the internal end 51 of cylindrical structure 44 and spiral approximately 180° along the circumference of the coil conductor 20. The plurality of slits 26 are generally equally spaced along the surface of the coil conductor 20 to define a plurality of current paths 55 of approximately one-half turn each about the circumference of the coil conductor 20. In the preferred embodiment of FIG. 2, three slits 26 are provided defining three current paths 55. However, any number of slits 26 (greater than two) may be provided. The angle of incidence between each slit 26 and the interior end 51 of coil 20 may be arbitrarily chosen, but in the preferred embodiment, is approximately 20 degrees.

The interior end 51 of tubular coil conductor 20 electrically connects to the main electrode 17 through a plurality of electrical connectors 12 associated one each with a respective current path 55. As shown in the preferred embodiment of FIG. 2, connectors 12 may comprise integral projections formed on the interior end 51 of coil conductor 20 or on the adjoining surface of the main electrode 17. Alternatively, connectors 12 may comprise electrically conducting clips permanently mounted to the interior end 51 of coil conductor 21 at the end of current path 55 adjacent to slit 26.

Referring still to FIGS. 1, 2 and 4, a copper ring 65 is interposed between the electrical connectors 12 of coil conductor 20 and the main electrode 17. Copper ring 65 preferably has an outer diameter equal to the outer diameter of coil conductor 20 and an inner diameter equal to the inner diameter of coil conductor 20.

Figures 5, 6:
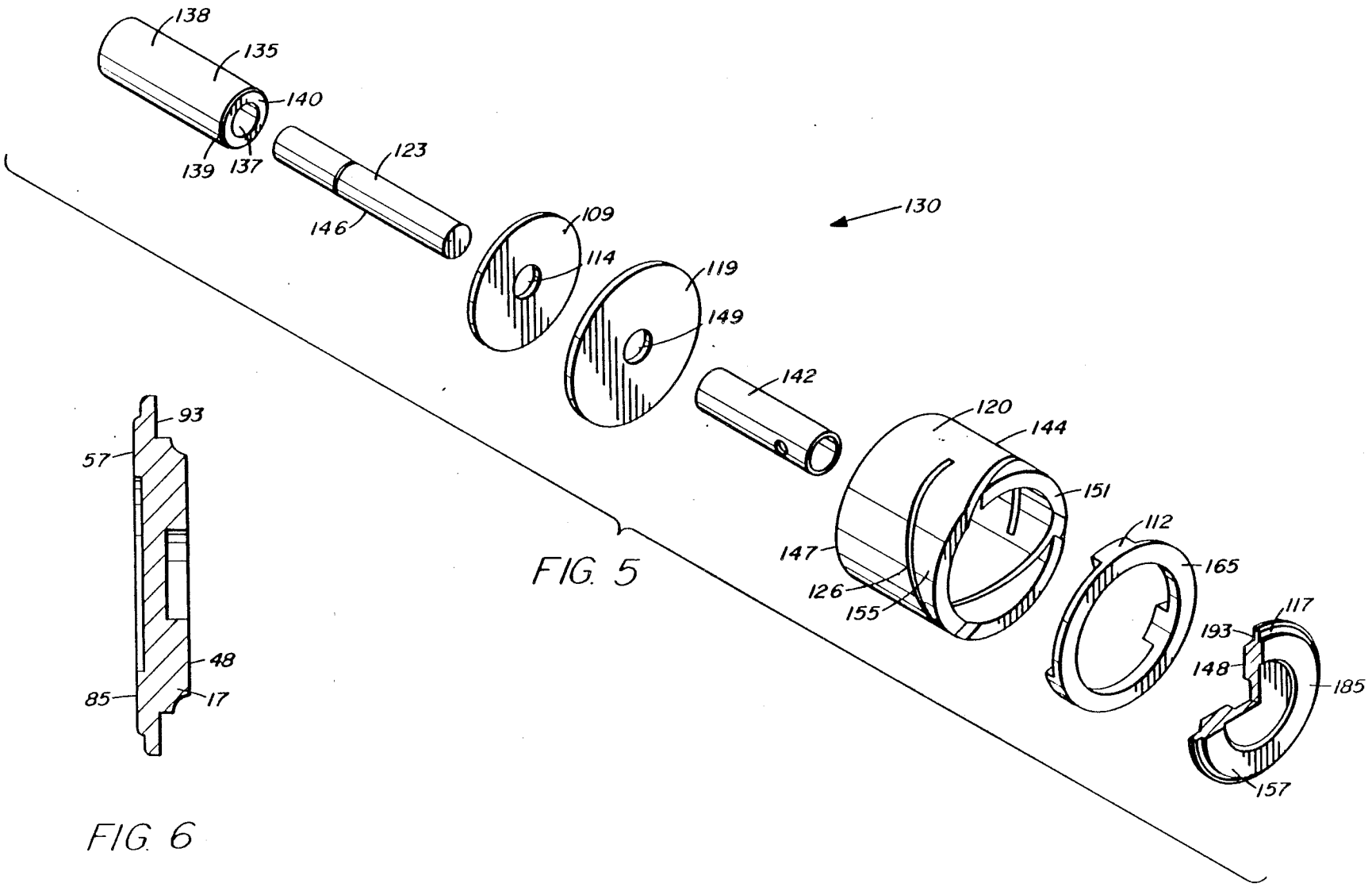
FIG. 5 is a perspective view of an alternative electrode structure shown in FIG. 3.
FIG. 6 is a sectional, schematic side elevation of one of the two main electrode structure shown in FIG. 1.

Referred now to FIGS. 2, 4 and 6, the main electrode 17 comprises an electrically conductive circular disk that connects electrically to electrical connectors 12 of coil conductor 20 through ring 65. Main electrode 17 preferably is constructed of chrome copper and has a diameter approximately equal to the diameter of coil conductor 20. The main electrode 17 includes an interior surface 57 facing the main electrode 17 of the opposing electrode structure and a back surface 48 facing the interior end 51 of coil conductor 20 and adjoining copper ring 65.

Referring still to FIGS. 2, 4 and 6, the interior surface 57 of the main electrode 17 includes a ring-shaped protrusion 85 forming a contact surface along the periphery of the main electrode 17. Thus, the main electrodes, when in a closed position, contact each other at protrusion 85. The back surface 48 of the main electrode 17 includes a peripheral groove 93 for receiving copper ring 65.

Referring now to FIGS. 1 and 4, structural support rod 23 is constructed of a high dielectric material and includes a stainless steel spacer 42 fixedly attached to the back surface 48 of main electrode 17 and a rod portion 46 extending through the electrode structure 30, along the central axis of vessel 15. Rod portion 46 of support rod 23 has a diameter slightly less than the inner diameter of the bore 37 in conductor rod 35. The rod portion 46 extends through coil conductor 20, end plate 9 and into bore 37 in external conductor rod 35, thereby co-axially aligning electrode structure 30 and reducing stress on coil conductor 20 and main electrode 17.

Referring now to FIG. 1, movable electrode structure 25 is constructed in a manner substantially the same as the stationary electrode structure 30 described supra. One difference, however, is that exterior end 11' of coil conductor 95 is received within the bellows 28.

The bellows 28 is any conventional bellows assembly having an interior end 75 engaging the exterior end 11' of coil conductor 20, an outer end 77 mounted to end plate 8, and a body portion 80 through which external conductor rod 35' extends. Interior end 75 receives therein the exterior end 11' of coil conductor 95. The bellows drives an actuator (not shown) mounted on the rod 35' to move rod 35' axially.

The coil conductor 95 of movable electrode 60, like coil conductor 20, comprises a plurality of slits 27 and electrical connectors 24 defining a plurality of current paths 56. In addition, a copper ring 65' is provided to facilitate the flow of current between the main electrode 17' and electrical connectors 24. The inclined slits 26, 27 are positioned approximately parallel to one another, with electrical connectors 12, 24 directly aligned. In operation, when the movable electrode structure 25 parts from stationery electrode structure 30 to interrupt current flow, an arc current flows across the electrode structures 25, 30. Current flows through one turn by passing through one current path 55, through connector 12, copper ring 65 main electrodes 17 and 17', through copper ring 65' and connector 24 and through current path 56.

The preferred embodiment of the invention has been shown in use with the electrode structure disclosed in U.S. Pat. No. 4,837,481. Alternatively, the principles of the present invention may be utilized with other electrode structures. For example, the present invention may be used with the electrode structure disclosed in U.S. Pat. No. 4,871,808, as described hereafter.

Figure 3:
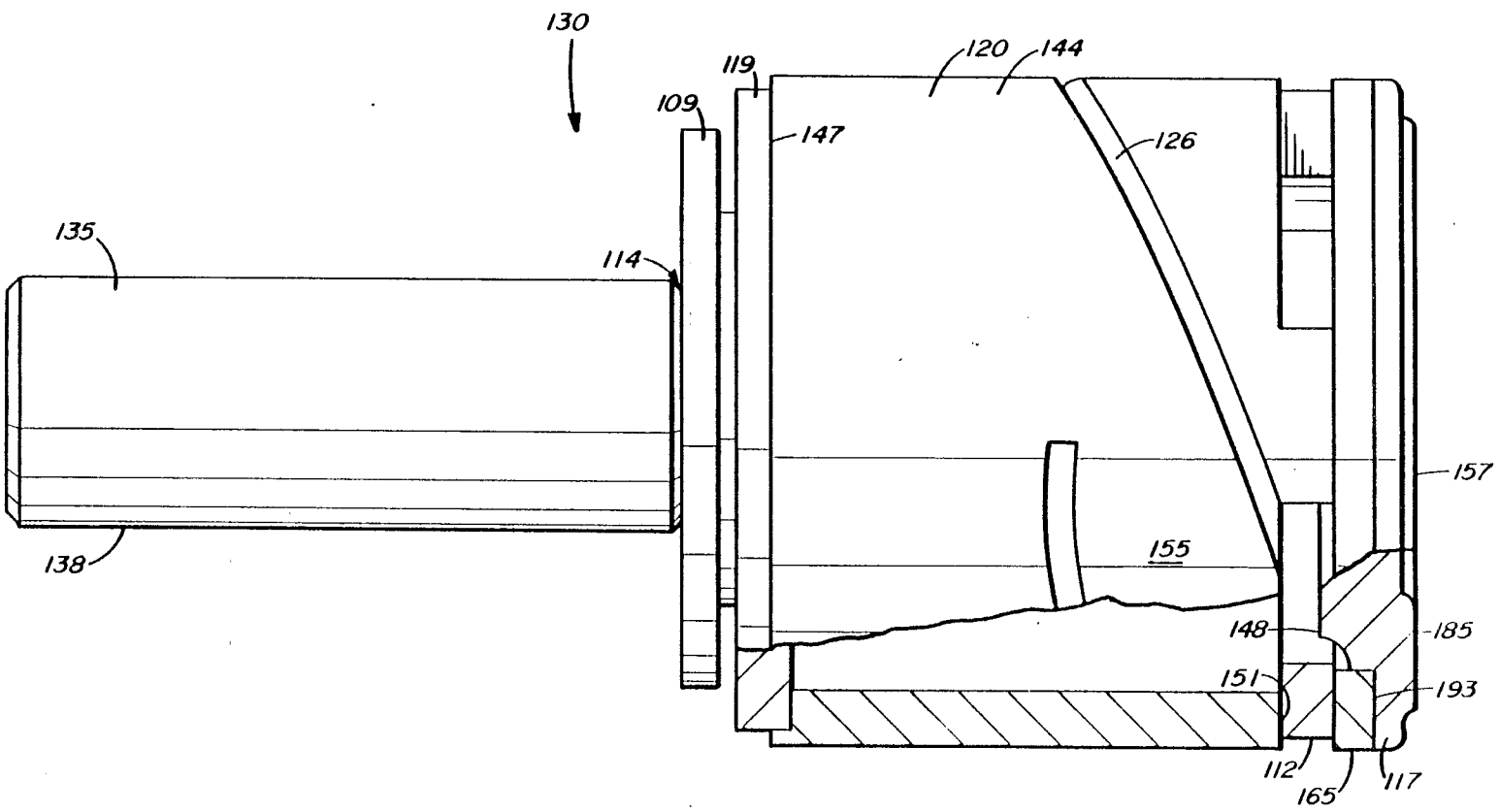
FIG. 3 is a partially sectional, schematic side elevation view of an alternative electrode structure as that shown in FIG. 2.

Referring now to FIGS. 3 and 5, the stationary electrode structure 30 constructed in accordance with the alternative embodiment comprises an external conductor rod 135 extending through the central aperture 14 of end plate 109, a conductor disk 119, a tubular coil conductor 120 electrically connected at one end to disk 119, a main electrode 117 electrically connected to coil conductor 120 and a structural support rod 123 extending along the central axis of the electrode structure 130.

The external conductor rod 135 is constructed of an electrically conductive material and includes an external end 138, an internal end 140 having an outer diameter slightly less than that of the external end, and a circumferential lip 139 defined by the juncture of the external and internal ends 138, 140. The conductor rod 35 also includes a central bore 137 extending axially through the rod 35. Upon assembly, the lip 139 engages the end plate 109 adjacent to the central aperture 14 with the external end 138 of rod 135 extending therefrom externally of the vacuum vessel 15 and the internal end 140 of the rod 135 protruding through aperture 14 into the interior of vacuum vessel 15 along the central axis of the vessel. The central bore 137 receives one end of the structural support rod 123 to concentrically align and mechanically support the electrode structure.

The conductor disk 119 comprises a generally cylindrical plate of electrically conductive material having a first outer diameter approximately the same as the outer diameter of the coil conductor 120. Conductor disk 119 also includes an axially extending aperture 149 for receiving therethrough the internal end 140 of the conductor rod 35. The conductor disk 119 fixedly attaches to the end plate 9 with the aperture 149 thereof co-axially aligned with central aperture 14 of end plate 9. The internal portion 140 of rod 135 extends through the aperture 149 of the conductor disk 119 to give the electrode structure 130 structural stability.

Referring still to FIGS. 3 and 5, the tubular coil conductor 20 constructed in accordance with the alternative embodiment comprises a uniform cylindrical structure 44 with an external end 147 engaging the conductor disk 119, an internal end 151, and a plurality of inclined slits 126 machined into the cylindrical structure 144. Cylindrical structure 144 is constructed of an electrically conductive material having a generally fixed radius, and connects electrically to conductor disk 119. Slits 126 extend from the internal end 151 of cylindrical structure 144 and spiral approximately 180° along the circumference of the cylindrical structure 144. The plurality of slits 126 are generally equally spaced along the surface of the cylindrical structure 144 to define a plurality of current paths 155 of approximately one-half turn each about the circumference of the tubular coil conductor 120. In the preferred embodiment of FIG. 1, three slits 126 are provided defining three current paths 55. However, any number of slits 126 (greater than two) may be provided. The angle of incidence between each slit 126 and the interior end 151 of coil 120 may be arbitrarily chosen, but in the preferred embodiment, is approximately 20 degrees.

The interior end 151 of tubular coil conductor 120 electrically connects to the main electrode 117 through a plurality of electrical connectors 112 associated one each with a respective current path 155. As shown in the alternative embodiment of FIG. 5, connectors 112 may be permanently attached to copper ring 165. In connectors 112 then are mounted to the interior end 151 of coil conductor 121 at the end of current path 155 adjacent to slit 126. Alternatively, connectors 12 may comprise integral projections formed on the interior end 151 of coil conductor 120.

Referring still to FIGS. 3 and 5, the copper ring 165, with electrical connectors formed thereon, has an outer diameter approximately equal to the outer diameter of tubular coil conductor 120, and an inner diameter that is slightly less than the inner diameter of tubular coil conductor 120.

Referring now to FIGS. 3, 5 and 6, the main electrode 117 has the same structure as described in the preferred embodiment and comprises an electrically conductive circular disk that connects electrically the copper ring 165. Main electrode 117 has a diameter approximately equal to the diameter of coil conductor 120 and defines an interior surface 157 facing the main electrode 117 of the opposing electrode structure and a back surface 148 facing the interior end 151 of coil conductor 120 and adjoining electrical connectors 112.

The interior surface 157 of the main electrode 117 includes a ring-shaped protrusion 185 forming a contact surface along the periphery of the main electrode 117. Thus, the main electrodes, when in the closed position, contact each other at protrusion 185. the back surface 148 of the main electrode 117 includes a peripheral groove 193 for receiving ring 165.

Referring now to FIGS. 3 and 5, structural support rod 123 is constructed of a high dielectric material and includes a space 142 fixedly attached to the back surface 148 of main electrode 117 and a rod portion 146 extending through the electrode structure 130, along the central axis of vessel 15. Rod portion 146 of support rod 123 has a diameter slightly less than the inner diameter of the bore 137 in conductor rod 135. The rod portion 146 extends through coil conductor 120, conductor disk 119, end plate 9 and into bore 137 in external conductor rod 135, thereby co-axially aligning electrode structure 130 and reducing stress on coil conductor 120 and main electrode 117.

Referring now to FIG. 3, movable electrode structure 25 is constructed in a manner substantially the same as the stationary electrode structure 30 described supra. Further details of the movable electrode structure 25 are disclosed in U.S. Pat. No. 4,871,828.

While a preferred embodiment of the invention has been shown and described, modifications can be made by one skilled in the art without departing in substance from the spirit of the invention.

What is claimed is:

1. A vacuum interrupter, comprising:

a first electrode structure disposed in a vacuum vessel, said first electrode structure having a main electrode;

a second electrode structure disposed within the vacuum vessel, said second electrode structure having a main electrode;

means for moving at least one of said first and second electrode structures axially of the other;

means for maintaining a low resistance path for current flowing through the main electrodes of said first and second electrode structures when the main electrodes are in contact, wherein said maintaining means includes a protrusion extending from the main electrodes for a contact point between the main electrodes.

2. A vacuum interrupter according to claim 1, wherein said first electrode structure includes;

a generally cylindrical conductor having a first end and a second end; and a plurality of inclined slits in the first end of said cylindrical conductor, said slits being spaced one from the next and extending generally circumferentially from the first end of said cylindrical conductor at an acute angle thereto.

3. A vacuum interrupter according to claim 2, wherein said first electrode structure further comprises a copper ring interposed between said cylindrical conductor and said main electrode.

4. A vacuum interrupter, comprising:

a first electrode structure disposed in a vacuum vessel; and a second opposed electrode structure disposed within the vacuum vessel, said second electrode structure being axially movable toward and away from said first electrode structure;

said first electrode structure and said second electrode structure each including a uniformly cylindrical coil conductor, a main electrode, and a copper ring interposed between said coil conductor and said main electrode for maintaining a low resistance current path through said main electrode.

5. A vacuum interrupter according to claim 4, wherein the main electrode includes a protrusion extending from a front surface of said electrode to define a contact point.

6. A vacuum interruption according to claim 5, wherein said main electrode includes a groove defined on the periphery of a back surface of the main electrode for receiving the copper ring.

7. A vacuum interrupter according to claim 6, wherein the protrusion on said main electrode has a ring-shaped configuration at a position on the front surface of the main electrode across the groove on the back surface to define a short current path between the protrusion and the groove.

8. A vacuum interrupter according to claim 4 wherein said cylindrical coil conductors include a plurality of inclined slits defining a plurality of current paths.

9. A vacuum interrupter according to claim 8, wherein said first electrode structure and said second electrode structure include a plurality of electrical connectors positioned at an end of the cylindrical coil conductor with one electrical connector associated with each current path.

10. A vacuum interrupter according to claim 9, wherein each current path defines a half turn on the cylindrical coil conductor.

11. A vacuum interrupter according to claim 10, wherein the plurality of inclined slits on said first electrode structure are positioned substantially in parallel with the plurality of inclined slits on said second electrode structure.

12. A vacuum interrupter according to claim 11, wherein the plurality of electrical connectors on said first electrode structure substantially align with the plurality of electrical connectors on said second electrode structure.

13. A vacuum interrupter, comprising:

a vacuum vessel with a first end plate and a second end plate;

a first coil conductor electrically connected to said first conductor disk, said first tubular coil conductor including a plurality of inclined slits on a portion of said first tubular coil conductor, defining a plurality of current paths through said first tubular coil conductor, with an electrical connector positioned at the end of each current path;

a first conductive ring electrically connected to said electrical connector;

a first main electrode electrically connected to the conductive ring;

a second main electrode positioned adjacent said first main electrode;

a second conductive ring electrically connected to said second main electrode;

a second coil conductor electrically connected to said second conductive ring, said second coil conductor including a plurality of inclined slits on a portion of said second tubular coil conductor, defining a plurality of current paths through said second tubular coil conductor.

* * * * *

UNITED STATES PATENT AND TRADEMARK OFFICE

CERTIFICATE OF CORRECTION

PATENT NO. : 4,982,059

DATED : January 1, 1991

INVENTOR(S) : Ernest F. Bestel

It is certified that error appears in the above—identified patent and that said Letters Patent is hereby corrected as shown below:

Column 9, line 19, claim 13, after "first" insert --tubular-- and change "said" to --a--.

Column 10, line 14, claim 13, after "second" insert --tubular--.

Signed and Sealed this

Twenty-ninth Day of December, 1992

*Attest:*

DOUGLAS B. COMER

*Attesting Officer*

*Acting Commissioner of Patents and Trademarks*